United States Patent [19]

Henderson et al.

[11] Patent Number: 4,696,703

[45] Date of Patent: Sep. 29, 1987

[54] CORROSION RESISTANT AMORPHOUS CHROMIUM ALLOY COMPOSITIONS

[75] Inventors: Richard S. Henderson; Michael A. Tenhover, both of Solon; Robert K. Grasselli, Aurora, all of Ohio

[73] Assignee: The Standard Oil Company, Cleveland, Ohio

[21] Appl. No.: 755,247

[22] Filed: Jul. 15, 1985

[51] Int. Cl.[4] ..... C22C 27/00

[52] U.S. Cl. ..... 148/403; 420/428; 420/588

[58] Field of Search ..... 148/403; 420/428, 588

[56] References Cited

U.S. PATENT DOCUMENTS 3,986,867 10/1976 Masumoto et al. ..... 75/126 A

OTHER PUBLICATIONS

Naka et al, Journal of Non-Crystalline Solids, vol. 31, pp. 355–365, 1979.

Masumoto et al, Annual Review of Material Science, vol. 8, pp. 215–233, 1978.

Glassy Metals: Magnetic, Chemical and Structural Properties, Chapter 8, CRC Press, Boca Raton, La., 1983.

*Primary Examiner*—R. Dean

*Attorney, Agent, or Firm*—Sue E. Phillips; Joseph G. Curatolo; Larry W. Evans

[57] ABSTRACT

An amorphous metal alloy composition exhibiting corrosion resistance in acidic environments of the formula:

$$Cr_aM_bB_cC_dR_e$$

wherein

M is at least one metal selected from the group consisting of Mo, W, Nb and Ta;

R is at least one element selected from the group consisting of N, P, As, S and Se; and wherein a ranges from about greater than 0.4 to about 0.6;

b ranges from about 0.15 to about less than 0.4; and c ranges from zero to about 0.16.

d ranges from zero to about 0.2; and e ranges from zero to about 0.3;

with the proviso that the sum of (c+d+e) ranges from about 0.04 to about 0.35.

20 Claims, No Drawings

CORROSION RESISTANT AMORPHOUS CHROMIUM ALLOY COMPOSITIONS

FIELD OF THE INVENTION

The present invention relates to amorphous chromium alloys that exhibit excellent corrosion resistance in strongly acidic and alkaline environments.

BACKGROUND OF THE INVENTION

The tendency of metals to corrode has long been a recognized concern. By corrosion is meant the degradation of a metal by the environment by either chemical or electrochemical processes. A large number of crystalline alloys have been developed with various degrees of corrosion resistance in response to various environmental conditions on to which the alloys must perform. As examples, stainless steel contains nickel, chromium and/or molybdenum to enhance its corrosion resistance. Glass and metals such as platinum, palladium, and tantalum are also known to resist corrosion in specific environments. The shortcomings of such materials lie in that they are not entirely resistant to corrosion and that they have restricted uses. Tantalum and glass resist corrosion in acidic envronments but are rapidly corroded by hydrogen fluoride and strong base solutions.

The corrosion resistance of an alloy is found generally to depend on the protective nature of the surface film, generally an oxide film. In effect, a film of a corrosion product functions as a barrier against further corrosion.

In recent years, amorphous metal alloys have become of interest due to their unique characteristics. While most amorphous metal alloys have favorable mechanical properties, they tend to have poor corrosion resistance. An effort has been made to identify amorphous metal alloys that couple favorable mechanical properties with corrosion resistance. Binary iron-metalloid amorphous alloys were found to have improved corrosion resistance with the addition of elements such as chromium or molybdenum, M. Naka et al. *Journal of Non-Crystalline Solids,* Vol. 31, page 355, 1979. Naka et al. noted that metalloids such as phosphorus, carbon, boron and silicon, added in large percentages to produce the amorphous state, also influenced its corrosion resistance.

T. Masumoto and K. Hashimoto, reporting in the *Annual Review of Material Science,* Vol. 8, page 215, 1978, found that iron, nickel and cobalt-based amorphous alloys containing a combination of chromium, molybdenum, phosphorus and carbon were found to be extremely corrosion resistant in a variety of environments. This has been attributed to the rapid formation of a highly protective and uniform passive film over the homogeneous, single-phase amorphous alloy which is devoid of grain boundaries and most other crystalline defects.

Many amorphous metal alloys prepared by rapid solidification from the liquid phase have been shown to have significantly better corrosion resistance than their conventionally prepared crystalline counterparts, as reported by R. B. Diegle and J. Slater in *Corrosion,* Vol. 32, page 155. 1976. Researchers attribute this phenomena to three factors: Structure, such as grain boundaries and dislocations; chemical composition; and homogeneity, which includes composition fluctuation and precipitates.

A thorough discussion of the corrosion properties of amorphous alloys can be found in Glassy Metals: Magnetic, Chemical, and Structural Properties, Chapter 8, CRC Press, Inc., 1983. In spite of advances made to understand the corrosion resistance of amorphous metal alloys, few alloys have been identified that exhibit little or no corrosion under extremely harsh acidic and/or alkaline environments. Those few alloys which do exhibit such properties utilize expensive materials in the alloy composition and so are prohibitive for many applications where their properties are desired. What is lacking in the field of amorphous metal alloys are economical alloy compositions that exhibit a high degree of corrosion resistance.

It is, therefore, one object of the present invention to provide amorphous metal alloy compositions having excellent corrosion resistance in acid environments.

It is another object of the invention to provide such amorphous metal alloy compositions in a cost-effective manner.

These and other objects of the present invention will become apparent to one skilled in the art in the following description of the invention and in the appended claims.

SUMMARY OF THE INVENTION

An amorphous metal alloy of the formula:

$$Cr_aM_bB_cC_dR_e$$

wherein

M is at least one metal selected from the group consisting of:

Mo, W, Nb and Ta;

R is at least one element selected from the group consisting of:

N, P, As, S and Se; and wherein a ranges from about greater than 0.4 to about 0.6;

b ranges from about 0.15 to about less than 0.4;

c ranges from zero to about 0.16;

d ranges from zero to about 0.2; and e ranges from zero to about 0.3; with the proviso that the sum of (c+d+e) ranges from about 0.04 to about 0.35.

DETAILED DESCRIPTION OF THE INVENTION

The compositions described herein are substantially amorphous metal alloys. The term "substantially" is used herein in reference to the amorphous metal alloys indicates that the metal alloys are at least 50 percent amorphous as indicated by x-ray defraction analysis. Preferably, the metal alloy is at least 80 percent amorphous. and most preferably about 100 percent amorphous, as indicated by x-ray defraction analysis. The use of the phrase "amorphous metal alloy" herein refers to amorphous metal-containing alloys that may also comprise non-metallic elements.

In accordance with the present invention there are provided amorphous metal alloy compositions having the ability to withstand corrosion under acidic conditions. These amorphous metal alloys are represented by the emperical formula:

$$Cr_aM_bB_cC_dR_e$$

wherein

M is at least one metal selected from the group consisting of Mo, W, Nb and Ta., R is at least one element selected from the group consisting of N, P, As, S and Se; and wherein a ranges from about greater than 0.4 to about 0.6;

b ranges from about 0.15 to about less than 0.4, c ranges from zero to about 0.16;

d ranges from zero to about 0.2; and e ranges from zero to about 0.3;

with the proviso that the sum of (c+d+e) ranges from about 0.04 to about 0.35.

Chromium is a mandatory element of the foregoing substantially amorphous metal alloy compositions. These amorphous compositions consist of chromium, a metal from the group of molybdenum, tungsten, niobium and tantalum, and at least one metalloid element.

Preferably, the ranges of a, b and (c+d+e) are as follows:

a ranges from about 0.45 to about 0.55;

b ranges from about 0.20 to about 0.35; and (c+d+e) ranges from about 0.15 to about 0.25.

Most preferably, the ranges of a, b and c are as follows:

a is about 0.50;

b ranges from about 0.25 to about 0.30; and (c+d+e) ranges from about 0.20 to about 0.25.

Amorphous metal alloy compositions of the present invention include $Cr_{50}Mo_{30}N_{20}$, $Cr_{50}Mo_{25}P_{25}$, $Cr_{50}Ta_{30}N_{20}$, $Cr_{50}Mo_{25}As_{25}$, $Cr_{50}Mo_{25}S_{25}$, $Cr_{40}Mo_{20}N_{20}$ and $Cr_{50}Ta_{30}P_{20}$. The foregoing list is not to be construed as limiting but merely exemplary. The amorphous metal alloy compositions taught herein are different from most amorphous compositions in the literature that claim corrosion resistance in that the compositions herein are conspicuous in the absence of iron, nickel and cobalt as is taught in the literature. However, it is to be recognized that the presence of other elements as impurities in these amorphous metal alloy compositions are not expected to significantly impair the ability of the alloy to resist corrosion. Thus, trace impurities such as O, Te, Si, Al, Ge, Sb, Sn and Ar are not expected to be seriously detrimental to the preparation and performance of these materials.

To insure the desired corrosion resistant properties of these amorphous metal alloy compositions, it is important to maintain the integrity of the amorphous state, and so it is not intended that these materials be exposed to an environment wherein the temperature of the alloy may reach or exceed its crystallization temperature.

The substantially amorphous metal alloys taught herein may exist as powders, solids or thin films. The alloys may exist separately or in conjunction with a substrate or other material. A coating of the amorphous metal alloy may be provided onto a substrate to impart the necessary corrosion resistance to the substrate material. Such a physical embodiment of the amorphous metal alloy may be useful as a coating on the interior surface of a chemical reaction vessel, as a coating on structural metal exposed to sea water or other strongly corrosive environments and as a coating on the surface of pipelines and pumps that transport acidic and/or alkaline chemicals. Copending patent application, U.S. Ser. No. 751705, entitled "Process for the Production of Multi-Metallic Amorphous Alloy Coatings" describes the formation of amorphous alloys such as those taught herein as coatings by means of chemical vapor deposition. The amorphous metal alloy, because of its inherent hardness, may also be fabricated into any shape, and used freestanding or on a substrate for applications in harsh environments.

The compositions taught herein can be prepared by any of the standard techniques for the synthesis of amorphous metal alloy materials. Thus, physical and chemical methods such as electron beam deposition, chemical reduction, thermal decomposition, ion cluster deposition. ion plating, liquid quenching, RF and DC sputtering may be utilized to form the compositions herein as well as the chemical vapor deposition method referred to hereinabove.

The following examples demonstrate the corrosion resistance of the compositons taught herein. It is to be understood that these examples are utilized for illustrative purposes only, and are not intended, in any way, to be limitative of the present invention.

EXAMPLES

The following examples contrast known corrosion resistant materials with several representative corrosion resistant amorphous metal alloys in accordance with the present invention.

The samples described and evaluated below were prepared by either RF sputtering or chemical vapor deposition.

Samples prepared by RF sputtering were formed in the following manner: A 2" research S-gun manufactured by Sputtered Films, Inc. was employed. As is known, DC sputtering can also be employed to achieve similar results. For each sample a glass substrate was positioned to receive the deposition of the sputtered amorphous metal alloy. The distance between the target and the substrate in each instance was about 10 cm. The thicknesses of the films were measured by a quartz crystal monitor located next to the deposition sight. The average film thickness was about 1000 Angstroms. Confirmation of film thickness was done with a Dektak II, a trade name of the Sloan Company.

Samples prepared by chemical vapor deposition were formed in accordance with the teaching of co-pending patent application U.S. Ser. No. 751705. A glass substrate was mounted on a heated copper block enclosed within a vacuum chamber. Mixtures of precursor compounds, both metal-containing and non-metal bearing, were introduced into the chamber and volatilized. The pressure in the chamber was maintained at about 2 torr. The compounds contacted the substrate, which was maintained at a temperature above the decomposition temperatures of the precursor compounds, whereupon an amorphous film was deposited on the substrate. Controlling the relative amounts of precursor compounds admitted to the chamber permitted adjustments of the film compositions with repect to the proportions of each components of the compositions. The films were deposited at a deposition rate of between about 500 and 1000 Angstroms per minute.

The samples to be tested were subjected to one or more of the following conditions:

6.5N HCl at 50° C.

6.5N HCl at 108° C.(reflux)

Concentrated HCl

Concentrated HF $HF/HNO_3$

A summary of each composition, method of sample preparation, and corrosion resistance is shown below in Table 1. A dashed line in the Table indicates that a test was not performed.

TABLE 1

Corrosion Resistance of Various Chromium Alloys

| Example | Sample Composition | Sample Preparation | Corrosion Rate (mm/yr) 6.5 N HCl (50° C.) | 6.5 N HCl (108° C.) (duration of test in hours) | Conc. HCl | Conc. HF | HF/ $HNO_3$ |
|---|---|---|---|---|---|---|---|
| 1 | Cr | RF* | 1167 | — | 5860 | — | — |
| 2 | $Cr_{54}N_{46}$ | CVD* | — | 0.25(7.5) | — | — | — |
| 3 | $Cr_{80}B_{20}$ | RF | — | 800(0.75) | — | — | — |
| 4 | $Cr_{50}Mo_{30}B_{20}$ | RF | — | 0.83(2) | — | — | — |
| 5 | $Cr_{50}Mo_{30}N_{20}$ | RF | — | 0.011(47) | — | 0.002 | — |
| 6 | $Cr_{50}Ta_{30}N_{20}$ | RF | — | 0.010(52) | — | 0.003 | — |
| 7 | $Cr_{50}Mo_{25}P_{25}$ | RF | — | 0.021(71) | — | 0.011 | — |
| 8 | $Cr_{50}Mo_{25}As_{25}$ | RF | — | 0.023 | — | 0.048 | 0.049 |
| 9 | $Cr_{50}Mo_{25}S_{25}$ | RF | — | 0.077(24) | — | 0.071 | 0.077 |
| 10 | $Cr_{50}Ta_{30}P_{20}$ | RF | — | 0.006(168) | — | — | — |
| 11 | $Cr_{40}Mo_{40}N_{20}$ | CVD | — | — | 0.00 | 0.00 | — |

*RF = RF Sputtering
CVD = Chemical Vapor Deposition

As a control, an RF sputtered chromium film, Example 1, was immersed for about 8 seconds after which time the sample was totally consumed in a stirred bath of 6.5N HCl maintained at about 50° C. After this brief immersion in HCl, a corrosion rate of approximately 1167 mm/yr was calculated for this material. When this composition was similarly immersed in concentrated hydrochloric acid for a brief period, a corrosion rate under these conditions of about 5860 mm/yr was observed.

Examples 2–4 evaluated amorphous chrome-metalloid compositions that are not taught herein. These samples were $Cr_{54}N_{46}$, $Cr_{80}B_{20}$ and $Cr_{50}Mo_{30}B_{20}$, respectively. The corrosion rates of these samples in 6.5N HCl, 108° C. reflux, ranged from about 0.25 to about 800 mm/yr. After testing in refluxing HCl, the $Cr_{80}B_{20}$ film of Example 3 was found to have a corrosion rate of about 800 mm/yr. The samples were tested for 7.5, 0.75 and 2 hours, respectively.

Examples 5–9 evaluated amorphous chromium alloys in accordance with this disclosure that, in 6.5N HCl, 108° C. reflux, exhibited corrosion rates of only between about 0.010 and about 0.077 mm/yr.

Additionally, the compositions taught in Examples 5–9 were also immersed in concentrated (50 percent) hydrofluoric acid. The corrosion rates of these materials under this condition range from about 0.003 to about 0.071 mm/yr.

Example 10 evaluated a composition taught herein that was formed by a chemical vapor deposition process. This composition, $Cr_{40}Mo_{40}N_{20}$, was immersed in concentrated hydrochloric acid and concentrated hydrofluoric acid, for about 24 hours in each environment. No corrosion of the vapor-deposited film was detected.

Examples 5–11 demonstrate the increased corrosion resistance of compositions disclosed herein of the formula $Cr_aM_bB_cC_dR_e$.

Thus it is seen that the compositions in accordance with the teaching herein exhibit excellent corrosion resistance to acid environments. The fact that the compositions are amorphous metal alloys also indicates that their mechanical properties are relatively high, and so the compositions should be quite useful in environments in which both erosion and corrosion resistance is needed. In addition, these compositions do not require the use of precious or semi-precious metals, and so are economically feasible for a wide range of practical applications.

Although several amorphous metal compositions have been exemplified herein, it will readily be appreciated by those skilled in the art that the other amorphous metal alloys encompassed in the teachings herein could be substituted therefore.

It is to be understood that the foregoing examples have been provided to enable those skilled in the art to have representative examples by which to evaluate the invention and that these examples should not be construed as any limitation on the scope of this invention. Inasmuch as the composition of the amorphous metal alloys employed in the present invention can be varied within the scope of the total specification disclosure, neither the particular M or R′ components nor the relative amounts of the components in the alloys exemplified herein shall be construed as limitations of the invention.

Thus, it is believed that any of the variables disclosed herein can readily be determined and controlled without departing from the spirit of the invention herein disclosed and described. Moreover, the scope of the invention shall include all modifications and variations that fall within that of the attached claims.

We claim:

1. An amorphous metal alloy of the formula $$Cr_aM_bB_cC_dR_e$$

wherein

M is at least one metal selected from the group consisting of Mo, W, Nb and Ta;

R is at least one element selected from the group consisting of N, P, As, S and Se; and wherein a ranges from about greater than 0.4 to about 0.6;

b ranges from about 0.15 to about less than 0.4;

c ranges from zero to about 0.16;

d ranges from zero to about 0.2; and e ranges from zero to about 0.3;

with the proviso that the sum of (c+d+e) ranges from about 0.04 to about 0.35.

2. The amorphous metal alloy in accordance with claim 1 wherein:

a ranges from about 0.45 to about 0.55;

b ranges from about 0.20 to about 0.35; and (c+d+e) ranges from about 0.15 to about 0.25.

3. The amorphous metal alloy in accordance with claim 1 wherein:

a is about 0.50;

b ranges from about 0.25 to about 0.30; and (c+d+e) ranges from about 0.20 to about 0.25.

4. The amorphous metal alloy in accordance with claim 1 wherein said amorphous metal alloy is at least 80 percent amorphous.

5. The amorphous metal alloy in accordance with claim 1 wherein said amorphous metal alloy is about 100 percent amorphous.

6. The amorphous metal alloy in accordance with claim 1 wherein said amorphous metal alloy comprises Cr, Mo and N.

7. The amorphous metal alloy in accordance with claim 6 wherein said amorphous metal alloy has an approximate composition $Cr_{50}Mo_{30}N_{20}$.

8. The amorphous metal alloy in accordance with claim 6 wherein said amorphous metal alloy has an approximate composition $Cr_{40}Mo_{40}N_{20}$.

9. The amorphous metal alloy in accordance with claim 1 wherein said amorphous metal alloy comprises Cr, Mo and P.

10. The amorphous metal alloy in accordance with claim 9 wherein said amorphous metal alloy has an approximate composition $Cr_{50}Mo_{25}P_{25}$.

11. The amorphous metal alloy in accordance with claim 1 wherein said amorphous metal alloy comprises Cr, Mo and As.

12. The amorphous metal alloy in accordance with claim 11 wherein said amorphous metal alloy has an approximate composition of $Cr_{50}Mo_{25}As_{25}$.

13. The amorphous metal alloy in accordance with claim 1 wherein said amorphous metal alloy comprises Cr, Mo and S.

14. The amorphous metal alloy in accordance with claim 13 wherein said amorphous metal alloy has an approximate composition of $Cr_{50}Mo_{25}S_{25}$.

15. The amorphous metal alloy in accordance with claim 1 wherein said amorphous metal alloy comprises Cr, Ta and N.

16. The amorphous metal alloy in accordance with claim 15 wherein said amorphous metal alloy has an approximate composition of $Cr_{50}Ta_{30}N_{20}$.

17. The amorphous metal alloy in accordance with claim 1 wherein said amorphous metal alloy comprises Cr, Ta and P.

18. The amorphous metal alloy in accordance with claim 17 wherein said amorphous metal alloy has an approximate composition of $Cr_{50}Ta_{30}P_{20}$.

19. The amorphous metal alloy in accordance with claim 1 wherein said amorphous metal alloy is synthesized by chemical vapor deposition.

20. The amorphous metal alloy in accordance with claim 1 wherein said amorphous metal alloy is synthesized by RF sputtering.

* * * * *